US008961276B2

(12) United States Patent
Nishida

(10) Patent No.: US 8,961,276 B2
(45) Date of Patent: Feb. 24, 2015

(54) COIN FEEDING DEVICE

(75) Inventor: Eisei Nishida, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 210 days.

(21) Appl. No.: 12/735,556

(22) PCT Filed: Jan. 29, 2008

(86) PCT No.: PCT/JP2008/051298
§ 371 (c)(1),
(2), (4) Date: Jul. 27, 2010

(87) PCT Pub. No.: WO2009/095995
PCT Pub. Date: Aug. 6, 2009

(65) Prior Publication Data

US 2010/0330892 A1 Dec. 30, 2010

(51) Int. Cl.

| | |
|---|---|
| ***G07D 1/00*** | (2006.01) |
| ***G07D 3/14*** | (2006.01) |
| ***G07D 1/02*** | (2006.01) |
| ***G07D 3/02*** | (2006.01) |
| ***G07D 3/16*** | (2006.01) |

(52) U.S. Cl.
CPC .. *G07D 3/14* (2013.01); *G07D 1/02* (2013.01); *G07D 3/02* (2013.01); *G07D 3/16* (2013.01)
USPC ..... 453/56; 453/7; 453/11

(58) Field of Classification Search
USPC ..... 453/7, 56, 11; 198/604, 607–613, 198/460.3, 459.1, 459.6, 462.1, 462.3, 198/369.2, 819
See application file for complete search history.

(56) References Cited

U.S. PATENT DOCUMENTS

| | | | | |
|---|---|---|---|---|
| 4,920,730 | A * | 5/1990 | Inoue et al. | 53/532 |
| 6,042,471 | A * | 3/2000 | Tanaka | 453/56 |
| 6,264,021 | B1 * | 7/2001 | Button et al. | 198/457.02 |
| 7,121,397 | B2 * | 10/2006 | Yuyama et al. | 193/35 R |
| 7,503,840 | B2 * | 3/2009 | Iwami et al. | 453/56 |
| 7,559,831 | B2 * | 7/2009 | Umeda | 453/11 |

FOREIGN PATENT DOCUMENTS

| | | | |
|---|---|---|---|
| EP | 1 471 473 A2 | 10/2004 | |
| EP | 1 770 658 A1 | 4/2007 | |
| JP | 55-39496 | 9/1980 | G07D 9/00 |
| JP | 63-183744 | 11/1988 | |
| JP | 7-61639 | 3/1995 | |

(Continued)

OTHER PUBLICATIONS

Japanese Office Action (corresponding to JP 2009-551346 (2 pages).

(Continued)

*Primary Examiner* — Jeffrey Shapiro
(74) *Attorney, Agent, or Firm* — Renner, Kenner, Greive, Bobak, Taylor & Weber

(57) ABSTRACT

The present invention provides a coin feeding device in which coin jam can be easily eliminated and coins causing a coin jam can be easily removed.

When a coin jam occurs between a transporting belt 57 and a separating roller 65, the separating roller 65 is moved by a moving unit 66 in a direction to expand a clearance 64 between the separating roller 65 and the transporting belt 57. By moving the separating roller 65, coin jam can be easily eliminated, and coins causing the coin jam can be easily removed.

3 Claims, 6 Drawing Sheets

(56) References Cited

FOREIGN PATENT DOCUMENTS

| | | | | |
|---|---|---|---|---|
| JP | 2002-245506 | 8/2002 | ..... | G07D 1/00 |
| JP | 3481816 | 10/2003 | ..... | G07D 9/00 |

OTHER PUBLICATIONS

European Search Report (Application No. 08704080.4—PCT/JP2008/051298) (dated Oct. 15, 2012—6 pages).

* cited by examiner

COIN FEEDING DEVICE

TECHNICAL FIELD

The present invention relates to a coin feeding device which feeds coins one by one.

BACKGROUND ART

Conventionally, in a coin handling machine such as a coin depositing and dispensing machine, a coin feeding device which can store coins and feed coins one by one is used.

This coin feeding device has a coin storing unit storing coins not aligned, a transporting belt which transports coins is provided on the bottom surface of the coin storing unit, and a separating roller is disposed above and opposed to the transporting direction of the transporting belt via a clearance in which coins pass in a single-layered state. This separating roller rotates in a direction opposite to the moving direction of the upper surface of the transporting belt to restrict coins fed by the transporting belt to be in a single-layered state.

In the coin feeding device having this structure, when feeding coins, coins may jam between the transporting belt and the separating roller. As causes of this coin jam, a plurality of coins enter and are stuck between the transporting belt and the separating roller while overlapping each other, coins are larger in diameter or thickness than coins to be handled, or are deformed coins, and in this case, the coins cannot pass through and are stuck between the transporting belt and the separating roller.

When a coin jam occurs, the coin jam may be eliminated by returning the coins causing the coin jam to the inside of the coin storing unit by rotating the transporting belt in a direction opposite to the transporting direction, however, if the coins are tightly stuck, the transporting belt cannot be rotated in the opposite direction. In this case, the coin jam is eliminated by pushing back the coins causing the coin jam to the inside of the coin storing unit by inserting an exclusive removing jig between the transporting belt and the separating roller from the feeding direction.

There is another structure in which coin jam hardly occurs by configuring the portion of the transporting belt opposed to the separating roller to withdraw downward when coins almost jam between the transporting belt and the separating roller (for example, refer to Patent document 1). However, in this structure, coin jam cannot be completely prevented, and when a coin jam occurs, the coin jam must be eliminated by using, for example, the exclusive removing jig as described above.

Patent document 1: Japanese Laid-Open Patent Publication No. 2002-245506 (page 4, FIG. 3)

DISCLOSURE OF THE INVENTION

Problems to be Solved by the Invention

In the conventional coin feeding device, when coins jam between the transporting belt and the separating roller, the coin jam must be eliminated by pushing back the coins causing the coin jam to the inside of the coin storing unit by inserting an exclusive removing jig between the transporting belt and the separating roller from the feeding direction, so that the coin jam cannot be easily eliminated.

When coins causing the coin jam cannot pass through between the transporting belt and the separating roller like coins large in diameter, thick, or deformed coins, even if the coins are just returned to the inside of the coin storing unit, coin jam occurs again, and therefore, the coins must be found among many coins stored in the coin storing unit and removed, so that this is troublesome.

The present invention has been made in view of these circumstances, and an object thereof is to provide a coin feeding device which can easily eliminate coin jam and easily remove coins causing the coin jam.

Means to Solve the Problems

A coin feeding device the present invention includes a transporting belt which transports coins; a separating roller which is opposed to the transporting belt via a clearance in which coins pass through in a single-layered state and restricts the coins fed by the transporting belt to be in a single-layered state; and a moving unit which moves at least one of the transporting belt and the separating roller in a direction to expand the clearance between the transporting belt and the separating roller.

With a coin feeding device of the present invention, the moving unit rotatably moves the separating roller around a predetermined pivot in a direction to expand the clearance between the separating roller and the transporting belt.

With a coin feeding device of the present invention, the moving unit slides the separating roller in a direction to expand the clearance between the separating roller and the transporting belt.

With a coin feeding device of the present invention, the moving unit rotatably moves at least a part of the transporting belt around a predetermined pivot in a direction to expand the clearance between the transporting belt and the separating roller.

With a coin feeding device of the present invention, the moving unit slides at least a part of the transporting belt in a direction to expand the clearance between the transporting belt and the separating roller.

Effects of the Invention

With the coin feeding device of the present invention, at least one of the transporting belt and the separating roller can be moved in a direction to expand the clearance between the transporting belt and the separating roller by the moving unit, so that coin jam can be easily eliminated, and coins causing the coin jam can be easily removed.

With the coin feeding device of the present invention, a coin jam can be easily eliminated and coins causing the coin jam can be easily removed by withdrawing the separating roller by rotatably moving the separating roller around the predetermined pivot by the moving unit.

With the coin feeding device of the present invention, a coin jam can be easily eliminated and coins causing the coin jam can be easily removed by withdrawing the separating roller by sliding the separating roller by the moving unit.

With the coin feeding device of the present invention, a coin jam can be easily eliminated and coins causing the coin jam can be easily removed by withdrawing at least a part of the transporting belt by rotatably moving the part around the predetermined pivot by the moving unit.

With the coin feeding device of the present invention, a coin jam can be easily eliminated and coins causing the coin jam can be easily removed by withdrawing at least a part of the transporting belt by sliding the part by the moving unit.

REFERENCE NUMERALS

26 Stacker as coin feeding device
57 Transporting belt
65 Separating roller
66 Moving unit

BEST MODE FOR CARRYING OUT THE INVENTION

Hereinafter, embodiments of the present invention will be described with reference to the drawings.

A first embodiment is shown in FIG. 1 to FIG. 4.

Figure 4:
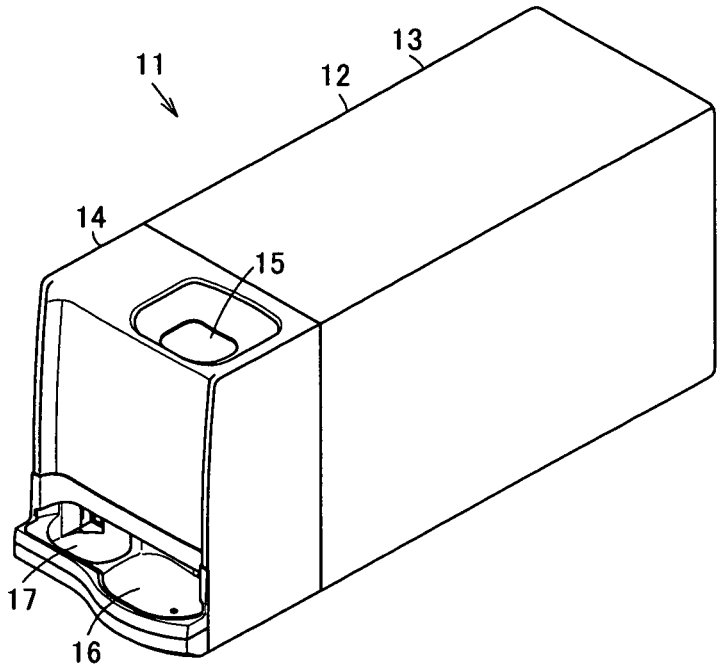
FIG. 4 is a perspective view of the same coin handling machine.

FIG. 4 is a perspective view of a coin handling machine 11. This coin handling machine 11 is electrically connected to, for example, a POS register, and can be used as an automatic change dispenser capable of automatically depositing and dispensing coins.

The machine body 12 of the coin handling machine 11 includes a frame body 13 having a front face opened and a main body unit 14 capable of being drawn out from the front face of the frame body 13.

A coin inlet 15 into which coins are input is formed on the upper face of the main body unit 14. On the front face right side of the main body unit 14, a coin dispensing outlet 16 from which coins are dispensed from the inside of the machine body 12 is formed, and on the front face left side of the main body unit 14, a reject port 17 to which coins unacceptable into the machine body 12 are returned is formed.

Figure 2:
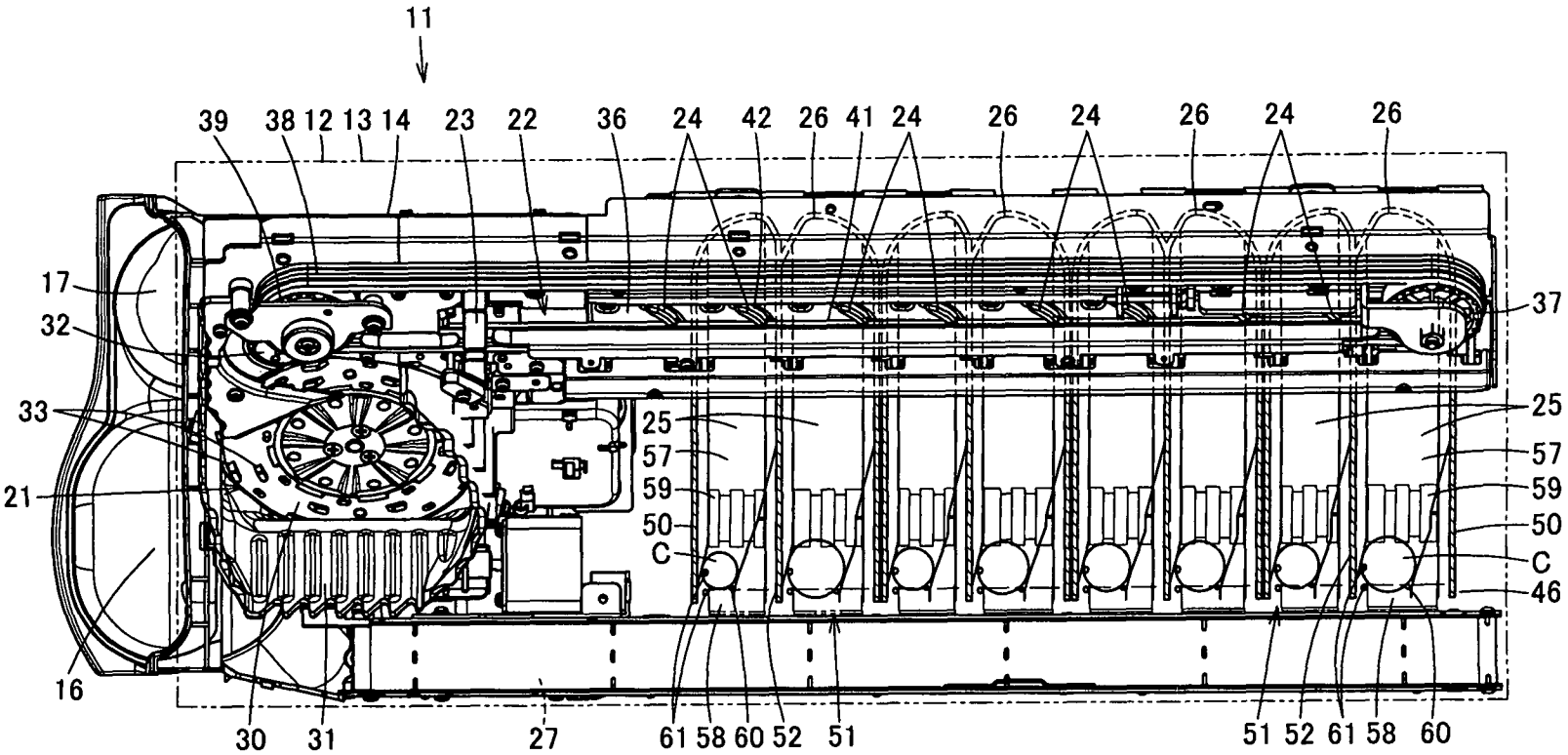
FIG. 2 is a plan view showing an internal structure of a coin handling machine to which the same coin feeding device is applied.
Figure 3:
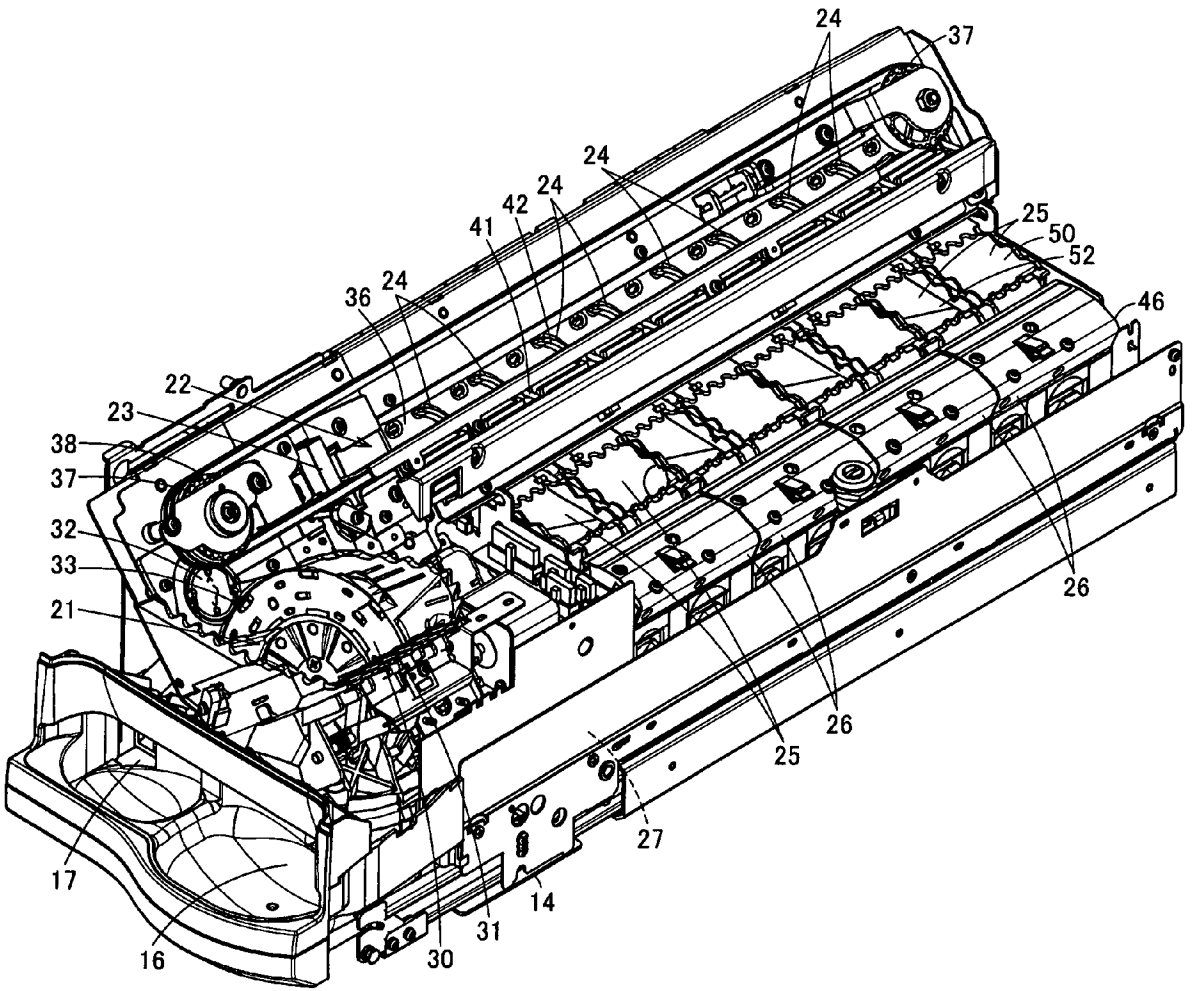
FIG. 3 is a perspective view showing the internal structure of the same coin handling machine.

Next, as shown in FIG. 2 and FIG. 3, the main body unit 14 includes a feeding unit 21 which receives coins (shown by the reference symbol C in the figures) input from the coin inlet 15 and feeds the coins one by one, a deposit transport unit 22 which transports coins fed from the feeding unit 21 rearward from the front side at the left side upper portion of the main body unit 14, a recognition unit 23 which recognizes coins to be transported by the deposit transport unit 22, a plurality of sorting units 24 which sort coins being transported by the deposit transport unit 22 by sorting according to results of recognition by the recognition unit 23, stackers 26 as a plurality of coin feeding devices, which are successively disposed from the front side to the rear side of the machine body 12, having coin storing units 25 which can store coins sorted by the sorting units 24 and feed the stored coins one by one to the right side of the main body unit 14, and a dispensing transport unit 27 which is disposed at the right side lower portion of the machine body 12 and transports coins fed from the coin storing units 25 to the coin dispensing outlet 16 positioned ahead.

Then, the feeding unit 21 includes a rotary disk 30 which rotates around a rotation axis at a position inclined at a predetermined angle with respect to the horizontal direction, a hopper 31 which pools coins not aligned between the hopper and the surface of the rotary disk 30, and a delivery disk 32 which delivers coins one by one from the upper portion of the rotary disk 30 to the deposit transport unit 22.

The rotary disk 30 is inclined so that the left side becomes higher and the right side becomes lower as viewed from the front face of the machine body 12, and is rotated by driving of a motor in a feed rotating direction (counterclockwise in FIG. 2 and FIG. 3) to feed coins to the deposit transport unit 22. On the surface of the rotary disk 30, a plurality of picking-up members 33 projecting from the surface of the rotary disk 30 are disposed at a predetermined pitch along the circumferential direction. When the rotary disk 30 rotates in the feed rotating direction, the picking-up members 33 hold and pick up the coins one by one to the upper region of the rotary disk 30.

The delivery disk 32 is arranged to deliver the coins picked up to the upper region on the rotary disk 30 by the picking-up members 33 to the deposit transport unit 22 one by one.

Next, the deposit transport unit 22 includes a deposit transport path 36 formed from the front side to the rear side at the left side upper portion of the main body unit 14. This deposit transport path 36 is flush with the surface of the rotary disk 30 and is inclined so that the left side is higher and the right side is lower as viewed from the front face of the machine body 12 similar to the inclination of the rotary disk 30.

Along the deposit transport path 36, a deposit transporting belt 38 is disposed by pulleys 37 disposed at the start end portion and the terminal end portion of the deposit transport path 36. The deposit transporting belt 38 rotates in the transporting direction to transport coins from the start end to the terminal end of the deposit transport path 36 by driving the pulleys 37 by motors. On the surface of the deposit transporting belt 38 opposed to the path surface of the deposit transport path 36, projections not shown which push and transport coins one by one are provided so as to project at a predetermined pitch along the belt longitudinal direction.

The rotation of the deposit transporting belt 38 and coin feeding by the rotary disk 30 and the delivery disk 32 of the feeding unit 21 are interlocked with each other, and coins fed from the feeding unit 21 are received one by one between projections adjacent to each other of the deposit transporting belt 38.

In the deposit transport path 36, the recognition unit 23 and the plurality of sorting units 24 are disposed in order along the transporting direction from the front side to the rear side.

Next, the recognition unit 23 detects materials and diameters, etc., of coins to be transported in the deposit transport path 36, and recognizes whether the coins are acceptable into the machine body 12 and denominations, etc., of acceptable coins.

Next, among the plurality of sorting units 24, a sorting unit 24 positioned at a sorting position on the most upstream side in the transporting direction of the deposit transport path 36 is a rejected coin sorting unit 24 which sorts coins unacceptable into the machine body 12, and the sorting units 24 at a plurality of sorting positions on the more transportation downstream side are denomination-specific sorting units 24 which sort coins acceptable into the machine body 12, and all sorting units are formed to have the same structure.

In each sorting unit 24, a sorting hole 41 enabling coins to be sorted is formed on the path surface of the deposit transport path 36, and a gate 42 which opens and closes the sorting hole 41 is disposed. This gate 42 allows coins being transported in the deposit transport path 36 to pass through when the gate 42 is at a coin passing position at which the gate 42 closes the sorting hole 41, and sorts coins being transported in the deposit transport path 36 into the sorting hole 41 when the gate 42 is at a coin sorting position at which the gate 42 opens the sorting hole 41. The gate 42 is forcibly switched between the coin passing position and the coin sorting position by an electric driving unit such as a solenoid or a motor not shown.

Coins sorted by the rejected coin sorting unit 24 are guided to a reject port 17 by a chute not shown. Coins sorted by the denomination-specific sorting units 24 are stored in the coin storing units 25 disposed corresponding to the sorting units 24 below the sorting units 24.

Figure 1:
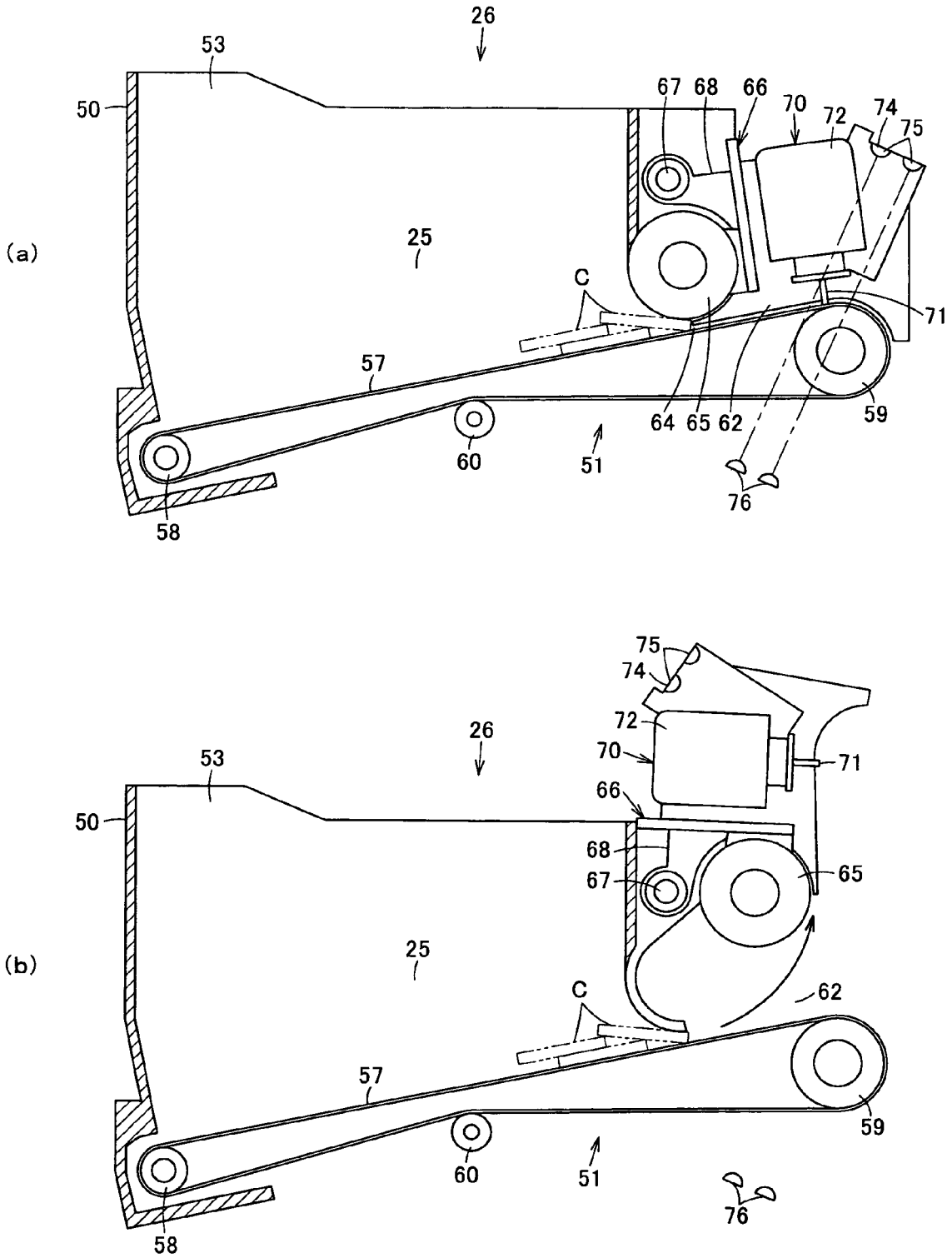
FIG. 1 show a coin feeding device according to a first embodiment of the present invention, and FIG. 1(*a*) is a sectional view in use and FIG. 1(*b*) is a sectional view showing a state where the separating roller is withdrawn.

Next, as shown in FIG. 1, the stackers 26 are arranged in the front-rear direction inside a stacker storing unit 46 formed in the region below the deposit transport unit 22 of the main body unit 14.

On each stacker 26, on the upper portion, a storing frame 50 forming two coin storing units 25 is formed, and on the lower portion, feeding mechanisms 51 which feed coins (shown by the reference symbol C in FIG. 1) one by one from the coin storing units 25 are disposed.

In the storing frame 50 of the stacker 26, a partitioning member 52 which partitions the interior of the storing frame 50 into two is formed, and by this partitioning member 52, two coin storing units 25 which store coins not aligned are formed. On the upper surfaces of the coin storing units 25, receiving ports 53 which receive coins sorted by the sorting units 24 of the deposit transport units 22 positioned above are formed.

The feeding mechanism 51 of the stacker 26 includes a transporting belt 57 disposed on the bottom portion of the coin storing unit 25 of the storing frame 50. This transporting belt 57 is suspended by rollers 58 and 59 which are axially supported in the horizontal direction at upstream side and downstream side positions in the coin transporting direction and rotatable, and suspended so as to incline and rise from the upstream side to the downstream side in the coin transporting direction, that is, from the deposit transport unit 22 on the left side toward the dispensing transport unit 27 on the right side. Further, the upper surface portion of the transporting belt 57 in contact with coins is supported by a guide not shown disposed under the upper surface. The reference numeral 60 denotes a guide roller which guides the lower side portion of the transporting belt 57. Coins in the coin storing unit 25 are supported on the upper surface of the transporting belt 57, the transporting belt 57 rotates together with the roller 59 driven to rotate by a motor not shown, and transports coins in the coin storing unit 25 to the dispensing transport unit 27.

At the end portion in the direction of coin transportation by the transporting belt 57, a coin feeding port 62 from which coins in the coin storing unit 25 are fed one by one to the dispensing transport unit 27 by the transporting belt 57 is formed.

Above the transporting belt 57 near the coin feeding port 62, a separating roller (reverse roller) 65 is disposed so as to be opposed to the transporting belt 57 via a clearance 64 which allows coins to pass through in a single-layered state. A driving force of a motor not shown is transmitted to this separating roller 65 and the separating roller rotates in a direction opposite to the direction of coin transportation by the transporting belt 57 to restrict coins fed by the transporting belt 57 one by one.

The separating roller 65 is supported by a moving unit 66 which rotatably moves the separating roller 65 between a home position as a restricting position at which the separating roller 65 keeps a predetermined clearance as the clearance 64 between the separating roller 65 and the transporting belt 57 and restricts coins fed by the transporting belt 57 one by one, and a withdrawn position at which the separating roller 65 expands the clearance 64 between the separating roller 65 and the transporting belt 57. This moving unit 66 includes a moving member 68 supported on the storing frame 50 of the stacker 26 so as to swing in the up-down direction around an axis 67, and the separating roller 65 is supported rotatably on this moving member 68. The moving member 68 is locked at the restricting position by a lock mechanism not shown, and is allowed to rotatably move to the withdrawn position on the upper side by releasing the lock by this lock mechanism.

Above the transporting belt 57 and closer to the coin feeding port 62 than the separating roller 65, a stopper mechanism 70 which restricts feeding of coins from the coin feeding port 62 is disposed. This stopper mechanism 70 includes a stopper 71 and a solenoid 72 which advances and retreats the stopper 71 to and from the coin feeding port 62 from above, and the stopper 71 enters the coin feeding port 62 to restrict feeding of coins, and the stopper 71 withdraws from the inside of the coin feeding port 62 to allow coins to be fed. The solenoid 72 is attached to the moving member 68 and moves integrally with the separating roller 65.

At the coin feeding port 62, for counting the number of fed coins, a sensor 74 as a coin detection unit which detects coins fed by passing through the coin feeding port 62 is provided. This sensor 74 projects and receives detection light through the lateral portion of the transporting belt 57 between an upper sensor unit 75 disposed above the transporting belt 57 and a lower sensor unit 76 disposed below the transporting belt 57 and detects feeding of coins based on detection light shaded by passage of the fed coins. The upper sensor unit 75 is attached to the moving member 68 and moves integrally with the separating roller 65.

Next, as shown in FIG. 2 and FIG. 3, the dispensing transport unit 27 includes a dispensing transporting belt not shown disposed along the front-rear direction of the main body unit 14, and places coins ejected from the coin feeding ports 62 of the plurality of coin storing units 25 on the dispensing transporting belt and transports the coins to the coin dispensing outlet 16 ahead.

Next, operations of the coin handling machine 11 of the present embodiment will be described.

First, a depositing operation will be described.

Coins input into the coin inlet 15 are received in the feeding unit 21. In the feeding unit 21, in response to start of a depositing operation, the rotary disk 30 and the delivery disk 32 rotate, and coins are picked up one by one by picking-up members 33 projecting from the surface of the rotary disk 30, and fed one by one to the deposit transport path 36 of the deposit transport unit 22 by the delivery disk 32.

In the deposit transport unit 22, the deposit transporting belt 38 rotates, and coins fed one by one from the feeding unit 21 into the deposit transport path 36 are transported while being pushed by the projections of the deposit transporting belt 38.

Coins to be transported in the deposit transport path 36 are recognized by the recognition unit 23.

As a result of recognition by the recognition unit 23, when a coin is unacceptable into the machine body 12, that is, a rejected coin, the rejected coin is sorted from the deposit transport path 36 by the rejected coin sorting unit 24 positioned on the most upstream side in the transporting direction of the deposit transport path 36 and returned to the reject port 17.

As a result of recognition by the recognition unit 23, when a coin is a normal coin acceptable into the machine body 12, the coin is transported to the position of the sorting unit 24 of the corresponding sort set in advance and sorted from the deposit transport path 36 to the coin storing unit 25 of the stacker 26.

The coins sorted by the denomination-specific sorting units 24 drop from the receiving ports 53 of the coin storing units 25 of the corresponding sorts into the coin storing units 25, and stored on the transporting belts 57 or on coins which have already been stored.

When no coin is recognized by the recognition unit 23 for a predetermined time, it is judged that handling of coins input into the coin inlet 15 has been completed, and driving of the feeding unit 21 and the deposit transport unit 22 is stopped and the depositing operation is ended.

Next, a dispensing operation will be described.

For example, in response to a signal of a dispensing command from the POS register, in the coin storing unit 25 of the stacker 26 storing coins of the corresponding sort to be dispensed, by rotating the transporting belt 57 and rotating the separating roller 65 reversely, the coins not aligned on the transporting belt 57 are fed one by one from the coin feeding port 62. Based on detection by the sensor 74, when the number of fed coins of the corresponding sort reaches the number of coins to be dispensed, feeding of coins is forcibly stopped by the stopper mechanism 70.

The coins fed from the coin feeding port 62 of the coin storing unit 25 are dispensed to the coin dispensing outlet 16 by the dispensing transport unit 27.

As shown in FIG. 1(*a*), when feeding coins from the coin storing unit 25 of the stacker 26, the coins may jam between the transporting belt 57 and the separating roller 65. As causes of this coin jam, in the case where a plurality of coins overlapping each other enter between the transporting belt 57 and the separating roller 65 and are stuck, the coins are larger in diameter or thickness than the coins to be handled, or the coins are deformed coins, the coins cannot pass through the clearance between the transporting belt 57 and the separating roller 65 and are stuck.

To eliminate the coin jam, the lock of the moving member 68 by the lock mechanism at the restricting position is released and the moving member 68 is rotatably moved to the withdrawn position around the axis 67 as shown in FIG. 1(*b*).

When rotatably moving the moving member 68 to the withdrawn position, the clearance 64 between the separating roller 65 and the transporting belt 57 gradually expands while the separating roller 65 moves toward the coin feeding port 62 opposite to the coin storing unit 25 on which the coin jam has occurred, so that even if coins are tightly stuck between the transporting belt 57 and the separating roller 65, the separating roller 65 can be rotatably moved to the withdrawn position together with the moving member 68, and the stuck state of the coins can be eliminated.

Further, by rotatably moving the moving member 68 to the withdrawn position, the solenoid 72 and the upper sensor unit 75 disposed above of the coin feeding port 62 are integrally withdrawn together with the separating roller 65 and the region above the coin feeding port 62 can be widely opened, so that the coins causing the coin jam can be exposed to the coin feeding port 62.

Therefore, the coin jam can be eliminated by removing the coins causing the coin jam through the coin feeding port 62.

After the coin jam is eliminated, as shown in FIG. 1(*a*), the moving member 68 is rotatably moved and returned to the restricting position and locked by the lock mechanism.

Thus, even if coins jam between the transporting belt 57 and the separating roller 65, the coin jam can be easily eliminated by moving the separating roller 65 by the moving unit 66 without using an exclusive removing jig.

When the coins causing a coin jam are coins with the potential for causing a coin jam, which cannot pass through the clearance between the transporting belt and the separating roller, such as large-diameter coins, thick coins, and deformed coins, if the coins causing a coin jam are only returned into the coin storing unit 25 by an exclusive removing jig as in the conventional case, coin jam is caused again, and in order to prevent this, coins with the potential for causing a coin jam must be found among many coins stored in the coin storing unit 25 and taken out, and this is troublesome. On the other hand, by moving the separating roller 65 by the moving unit 66, the coins with the potential for causing a coin jam can be easily identified and removed through the coin feeding port 62.

Figure 5:
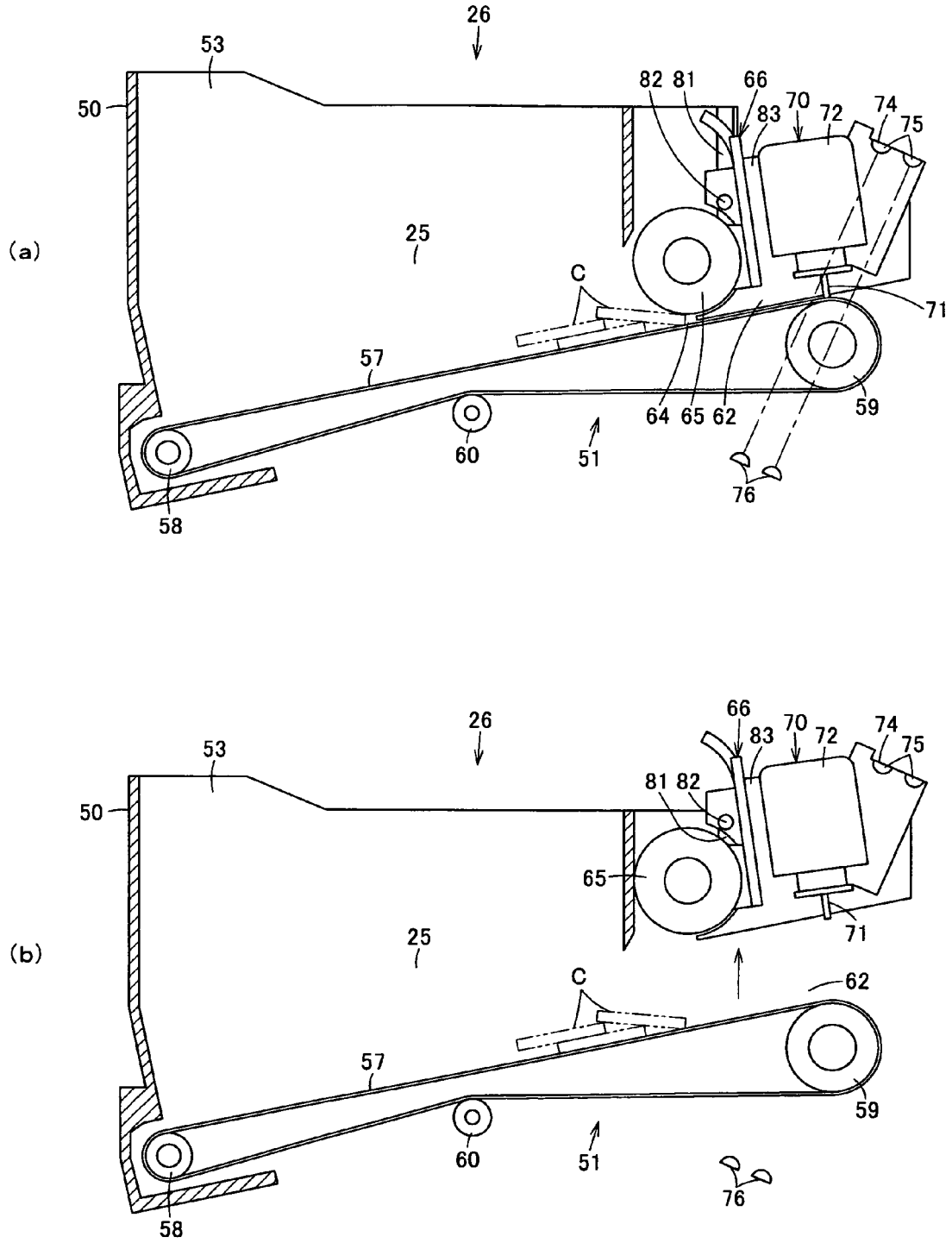
FIG. 5 show a coin feeding device according to a second embodiment of the present invention, and FIG. 5(*a*) is a sectional view in use and FIG. 5(*b*) is a sectional view of a state where a separating roller is withdrawn.

The moving unit 66 is not limited to rotatably moving the separating roller 65 around the axis 67 in a direction to expand the clearance 64 between the separating roller 65 and the transporting belt 57, but may slide the separating roller 65 in a direction to expand the clearance 64 between the separating roller 65 and the transporting belt 57 as in the second embodiment shown in FIG. 5.

This moving unit 66 includes a groove portion 81 provided along the up-down direction on the storing frame 50 of the stacker 26 and a moving member 83 supported slidably in the up-down direction via a slide axis 82 engaging movably along the groove portion 81, and the separating roller 65, the solenoid 72 and the upper sensor unit 75 are attached integrally to the moving member 83. This moving member 83 is also locked by a lock mechanism not shown at a restricting position, and is allowed to slide to the withdrawn position on the upper side by releasing the lock by the lock mechanism.

Then, as shown in FIG. 5(*a*), when feeding coins from the coin storing unit 25 of the stacker 26, in order to eliminate coin jam occurring between the transporting belt 57 and the separating roller 65, the lock of the moving member 83 by the lock mechanism at the restricting position is released, and as shown in FIG. 5(*b*), the moving member 68 is slid to the withdrawn position on the upper side along the groove portion 81 with which the slide axis 82 engages.

When sliding the moving member 83 to the withdrawn position, the separating roller 65 moves in a direction to expand the clearance 64 between the separating roller 65 and the transporting belt 57, so that even if coins are tightly stuck between the transporting belt 57 and the separating roller 65, the separating roller 65 can be slid to the withdrawn position on the upper side together with the moving member 68, so that the stuck state of the coins can be eliminated.

Moreover, by sliding the moving member 68 to the withdrawn position, the solenoid 72 and the upper sensor unit 75 disposed above the coin feeding port 62 can be withdrawn integrally together with the separating roller 65 and the region above the coin feeding port 62 can be widely opened, so that the coins causing a coin jam can be exposed to the coin feeding port 62.

Therefore, by removing coins causing a coin jam through the coin feeding port 62, the coin jam can be eliminated.

After the coin jam is eliminated, as shown in FIG. 5(*a*), the moving member 68 is slid and returned to the restricting position on the lower side, and locked by the lock mechanism.

Therefore, in this case, as in the case where the separating roller 65 is rotatably moved, coin jam can also be easily eliminated.

Figure 6:
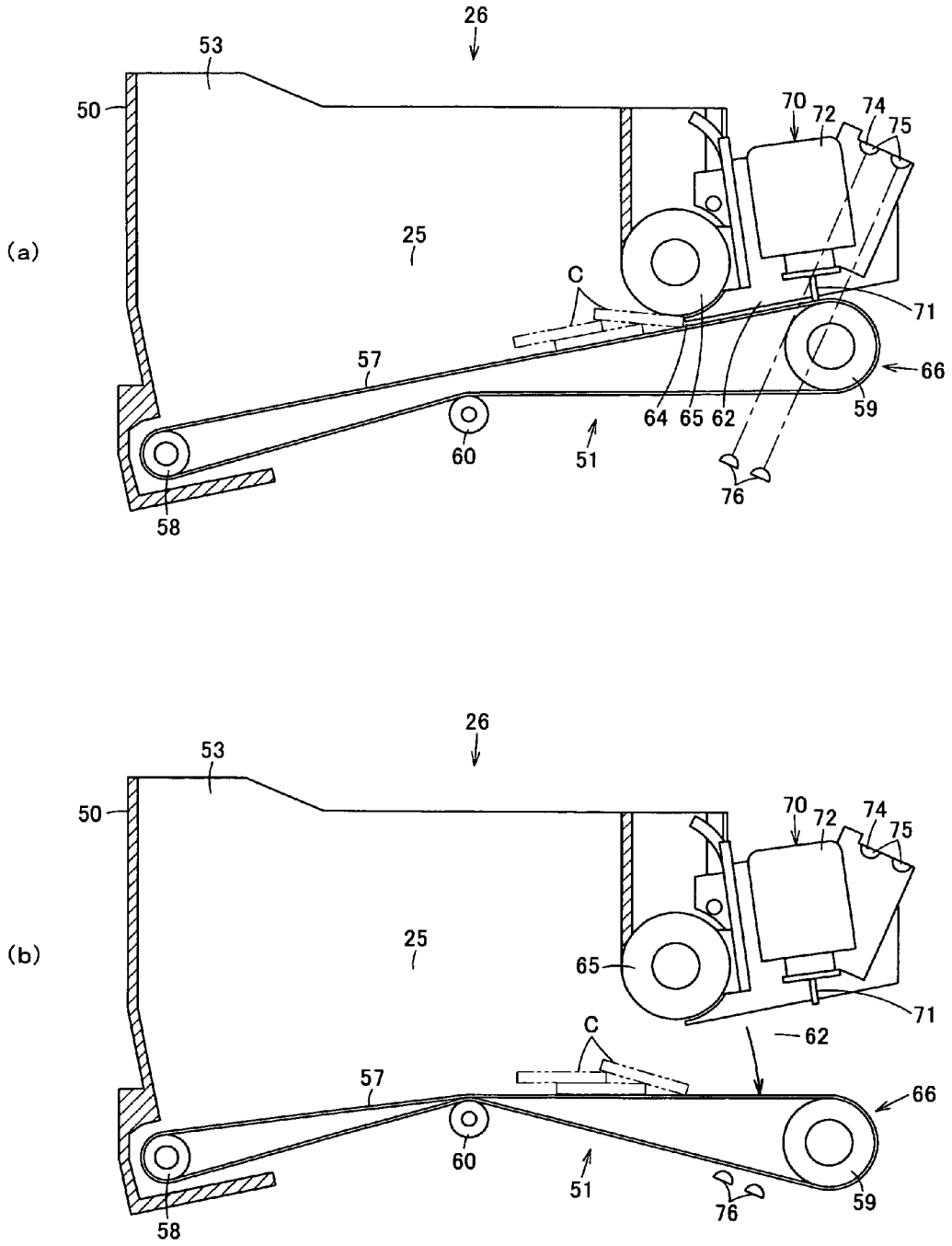
FIG. 6 show a coin feeding device according to a third embodiment of the present invention, and FIG. 6(*a*) is a sectional view in use and FIG. 6(*b*) is a sectional view of a state where a transporting belt is withdrawn.

The moving unit 66 is not limited to moving the separating roller 65 in a direction to expand the clearance 64 between the separating roller 65 and the transporting belt 57, but may move the transporting belt 57 in a direction to expand the clearance 64 between the transporting belt 57 and the separating roller 65 as in the third embodiment shown in FIG. 6.

With this moving unit 66, the roller 59 positioned on the end portion in the transporting direction of the transporting belt 57 below the coin feeding port 62 is supported on a moving member not shown which rotatably moves around a predetermined axis or supported on a supporting member not shown which slides. Accordingly, the end portion in the transporting direction of the transporting belt 57 positioned below the coin feeding port 62 can be moved between a home position as a restricting position at which coins fed by the transporting belt 57 are restricted one by one by keeping the clearance 64 between the transporting belt 57 and the separating roller 65 as predetermined, and a withdrawn position on the lower side at which the clearance 64 between the transporting belt 57 and the separating roller 65 is expanded. This moving member is also locked by a lock mechanism not shown at the restricting position, and is allowed to move to the withdrawn position by releasing the lock by the lock mechanism.

As shown in FIG. 6(*a*), when feeding coins from the coin storing unit 25 of the stacker 26, in order to eliminate coin jam occurring between the transporting belt 57 and the separating roller 65, the lock of the moving member by the lock mechanism at the restricting position is released, and as shown in FIG. 6(*b*), the moving member is moved to the withdrawn position on the lower side by rotation or sliding.

When moving the moving member to the withdrawn position, the transporting belt 57 moves in a direction to expand the clearance 64 between the transporting belt 57 and the separating roller 65, so that even if coins are tightly stuck between the transporting belt 57 and the separating roller 65, the transporting belt 57 can be moved to the withdrawn position on the lower side together with the moving member, so that the stuck state of the coins can be eliminated.

Further, by moving the transporting belt 57 to the withdrawn position, the region below the coin feeding port 62 can be widely opened, so that the coins causing a coin jam can be exposed to the coin feeding port 62.

Therefore, by removing coins causing a coin jam from the coin feeding port 62, the coin jam can be eliminated.

After the coin jam is eliminated, as shown in FIG. 6(*a*), the moving member is moved and returned to the restricting position on the upper side, and locked by the lock mechanism.

Therefore, in this case, coin jam can also be easily eliminated as in the case where the separating roller 65 is moved.

As an embodiment for expanding the clearance 64 between the separating roller 65 and the transporting belt 57 by moving the separating roller 65 by the moving unit 66, in addition to the method in which the separating roller 65 is rotatably moved upward, the separating roller 65 may be rotated in another direction such as the lateral direction, and in addition to the method in which the separating roller 65 is slid upward, the separating roller 65 may be slid in the axial direction or slid to the coin feeding side, and moreover, the separating roller 65 may be arranged to be removed to the upper side or the coin feeding side with respect to the stacker 26.

Alternatively, both of the separating roller 65 and the transporting belt 57 may be arranged to move in a direction to expand the clearance 64.

INDUSTRIAL APPLICABILITY

A coin feeding device of the present invention is used for, in addition to coin storing units which store coins by sorting and feeding them, all other feeding structures which feed coins one by one by using a transporting belt and a separating roller, such as a feeding unit which receives input coins and feeds them.

The invention claimed is:

1. A coin feeding device comprising:

a transporting belt which transports coins that are not aligned;

a separating roller which is opposed to the transporting belt via a clearance in which coins pass through in a single-layered state, the separating roller rotating in a direction opposite to the direction of coin transportation by the transporting belt, and restricts the coins fed by the transporting belt to be in a single-layered state; and a moving unit configured to hold the separating roller in a restricting position to restrict the clearance between the transporting belt and the separating roller, such that coins pass through the clearance in a single-layered state, wherein when the moving unit releases the holding state, the moving unit rotatably moves the separating roller to the downstream side of the coin transporting direction of the transporting belt around a pivot, which is located above the separating roller at a restricting position, and moves the separating roller to a withdrawn position to expand the clearance between the transporting belt and the separating roller.

2. A coin feeding device comprising:

a transporting belt which transports coins that are not aligned;

a separating roller which is opposed to the transporting belt via a clearance in which coins pass through in a single-layered state, the separating roller rotating in a direction opposite to the direction of coin transportation by the transporting belt, and restricts the coins fed by the transporting belt to be in a single-layered state; and a moving unit configured to be arranged at a more downstream side than the separating roller in the coin transporting direction of the transporting belt, the moving unit configured to hold the separating roller in a restricting position to restrict the clearance between the transporting belt and the separating roller, such that coins pass through the clearance in a single-layered state, wherein when the moving unit releases the holding state, the moving unit moves the separating roller by sliding the separating roller in a direction to a withdrawn position to expand the clearance between the transporting belt and the separating roller by sliding the separating roller in a direction that is more toward the downstream side than a direction perpendicular to an upper surface of the transporting belt in the coin transporting direction of the transporting belt.

3. A coin feeding device comprising:

a transporting belt which transports coins that are not aligned;

a separating roller which is opposed to the transporting belt via a clearance in which coins pass through in a single-layered state, the separating roller rotating in a direction opposite to the direction of coin transportation by the transporting belt, and restricts the coins fed by the transporting belt to be in a single-layered state; and a moving unit configured to hold the transporting belt in a restricting position to restrict the clearance between the transporting belt and the separating roller, such that coins pass through the clearance in a single-layered state, wherein when the moving unit releases the holding state, the portion of the transporting belt which is closest to the separating roller at a restricting position rotatably moves away from the separating roller to the downstream side in the coin transporting direction of the transporting belt around a pivot, which is located at a more upstream side than the separating roller in the coin transporting direction of the transporting belt and below an upper surface of the transporting belt, and moves the transporting belt to a withdrawn position to expand the clearance between the transporting belt and the separating roller.

* * * * *